US008613174B2

(12) United States Patent
Garrett

(10) Patent No.: US 8,613,174 B2
(45) Date of Patent: Dec. 24, 2013

(54) WEB STRUCTURE FOR KNOCKDOWN INSULATING CONCRETE BLOCK

(75) Inventor: David Michael Garrett, Oklahoma City, OK (US)

(73) Assignee: Buildblock Building Systems, LLC, Oklahoma City, OK (US)

( * ) Notice: Subject to any disclaimer, the term of this patent is extended or adjusted under 35 U.S.C. 154(b) by 0 days.

(21) Appl. No.: 13/095,550

(22) Filed: Apr. 27, 2011

(65) Prior Publication Data

US 2012/0096797 A1 Apr. 26, 2012

Related U.S. Application Data

(60) Provisional application No. 61/328,499, filed on Apr. 27, 2010.

(51) Int. Cl.
*E04C 2/288* (2006.01)

(52) U.S. Cl.
USPC ..... 52/309.11; 52/426; 52/427; 52/428

(58) Field of Classification Search
USPC ..... 52/309.11, 309.12, 424–428, 442, 562, 52/564, 565
See application file for complete search history.

(56) References Cited

U.S. PATENT DOCUMENTS 4,229,920 A * 10/1980 Lount ..... 52/309.12
4,698,947 A * 10/1987 McKay ..... 52/309.12
4,894,969 A 1/1990 Horobin
5,014,480 A 5/1991 Guarriello et al.
5,060,446 A 10/1991 Beliveau
5,123,222 A 6/1992 Guarriello et al.
5,428,933 A 7/1995 Philippe
5,459,971 A 10/1995 Sparkman
5,570,552 A 11/1996 Nehring
5,657,600 A 8/1997 Mensen
5,704,180 A 1/1998 Boeck
5,839,243 A 11/1998 Martin
5,852,907 A 12/1998 Tobin et al.
5,896,714 A 4/1999 Cymbala et al.
6,176,059 B1 1/2001 Cantarano et al.
6,230,462 B1 5/2001 Beliveau
6,240,692 B1 * 6/2001 Yost et al. ..... 52/426
6,293,067 B1 9/2001 Meendering
6,314,697 B1 * 11/2001 Moore, Jr. ..... 52/426
6,321,497 B1 11/2001 Cormier (Continued)

OTHER PUBLICATIONS

International Search Report (PCT/US05/44431); Aug. 7, 2006.

(Continued)

*Primary Examiner* — Adriana Figueroa
(74) *Attorney, Agent, or Firm* — Dunlap Codding, P.C.

(57) ABSTRACT

A web structure for connecting two foam panels comprising a pair of web inserts adapted to be molded in the foam panels. Each of the web inserts has an elongated end plate and a pair of central male connector members supported by the elongated end plate. A pair of bridges is connected to the web inserts so as to extend between the foam panels. Each of the bridges having a cross member, a first female connector member formed on one end of the cross member and a second female connector member formed on an opposing end of the cross member. The first and second female connector members each having a cavity shaped to matingly receive one of the central male connector members of the web inserts from a lateral side of the first and second female connector members.

10 Claims, 12 Drawing Sheets

(56) References Cited

U.S. PATENT DOCUMENTS

| | | | | |
|---|---|---|---|---|
| 6,336,301 | B1 * | 1/2002 | Moore, Jr. | 52/426 |
| 6,363,683 | B1 * | 4/2002 | Moore, Jr. | 52/741.13 |
| 6,401,419 | B1 * | 6/2002 | Beliveau | 52/592.6 |
| 6,438,918 | B2 | 8/2002 | Moore, Jr. et al. | |
| 6,536,172 | B1 | 3/2003 | Amend | |
| 6,792,729 | B2 * | 9/2004 | Beliveau | 52/426 |
| 6,820,384 | B1 | 11/2004 | Pfeiffer | |
| 7,024,833 | B1 | 4/2006 | Rice | |
| 7,082,732 | B2 * | 8/2006 | Titishov | 52/426 |
| 7,805,906 | B2 | 10/2010 | Garrett | |
| 7,827,752 | B2 * | 11/2010 | Scherrer | 52/426 |
| 8,037,652 | B2 * | 10/2011 | Marshall et al. | 52/309.11 |
| 2002/0014048 | A1 * | 2/2002 | Meendering | 52/426 |
| 2003/0005659 | A1 * | 1/2003 | Moore, Jr. | 52/473 |
| 2003/0029106 | A1 | 2/2003 | Cooper et al. | |
| 2003/0213198 | A1 * | 11/2003 | Bentley | 52/415 |
| 2004/0045237 | A1 | 3/2004 | Coombs et al. | |
| 2004/0045238 | A1 | 3/2004 | Dunn et al. | |

OTHER PUBLICATIONS

International Search Report and Written Opinion (PCT/US2011/034171); Jan. 2, 2012.

* cited by examiner

WEB STRUCTURE FOR KNOCKDOWN INSULATING CONCRETE BLOCK

CROSS-REFERENCE TO RELATED APPLICATIONS

This application claims benefit of U.S. Provisional Application No. 61/328,499, filed Apr. 27, 2010, which is incorporated herein by reference in its entirety.

BACKGROUND OF THE INVENTION

1. Field of the Invention

This invention relates generally to insulating concrete forms, and more particularly, but not by way of limitation, to a web structure for a knockdown insulating concrete block.

2. Brief Description of Related Art

A variety of insulating concrete form systems (also known as insulated concrete forms or blocks) exist for casting a concrete wall. Often, these systems include interlockable blocks that are formed from a pair of opposed foam panels connected together in a spaced, parallel relationship by a plurality of web members to define a concrete receiving cavity. The blocks are aligned and stacked to define a wall, and concrete is poured into the concrete receiving cavities. The blocks are maintained in place after the concrete hardens to insulate the concrete, provide a sound barrier, insulation, and serve as a backing for finishing material, such as drywall, stucco, siding, or brick.

In one form, blocks are manufactured with the web members embedded in the foam panels so that the foam panels are interconnected to one another. The fully assembled blocks and then shipped to a construction site. The cost to ship such pre-assembled blocks can be costly due to the bulkiness of the blocks. Also, there is a risk of damage to the blocks during transportation.

In another form, blocks are shipped in an unassembled condition. Such blocks are commonly referred to as a "knockdown blocks." The unassembled blocks are designed to be assembled at the construction site. However, the assembly of knockdown blocks can be tedious and time consuming. Furthermore, the assembled block often lack the desired rigidity for supporting the concrete due to the number of connection points between the web members and the foam panels.

To this end, a need exists for an improved web structure for a knockdown insulating concrete form that overcomes the problems experienced with use of the prior art systems. It is to such a web structure that the inventive concepts disclosed herein are directed.

DETAILED DESCRIPTION OF EXEMPLARY EMBODIMENTS

Figure 1:
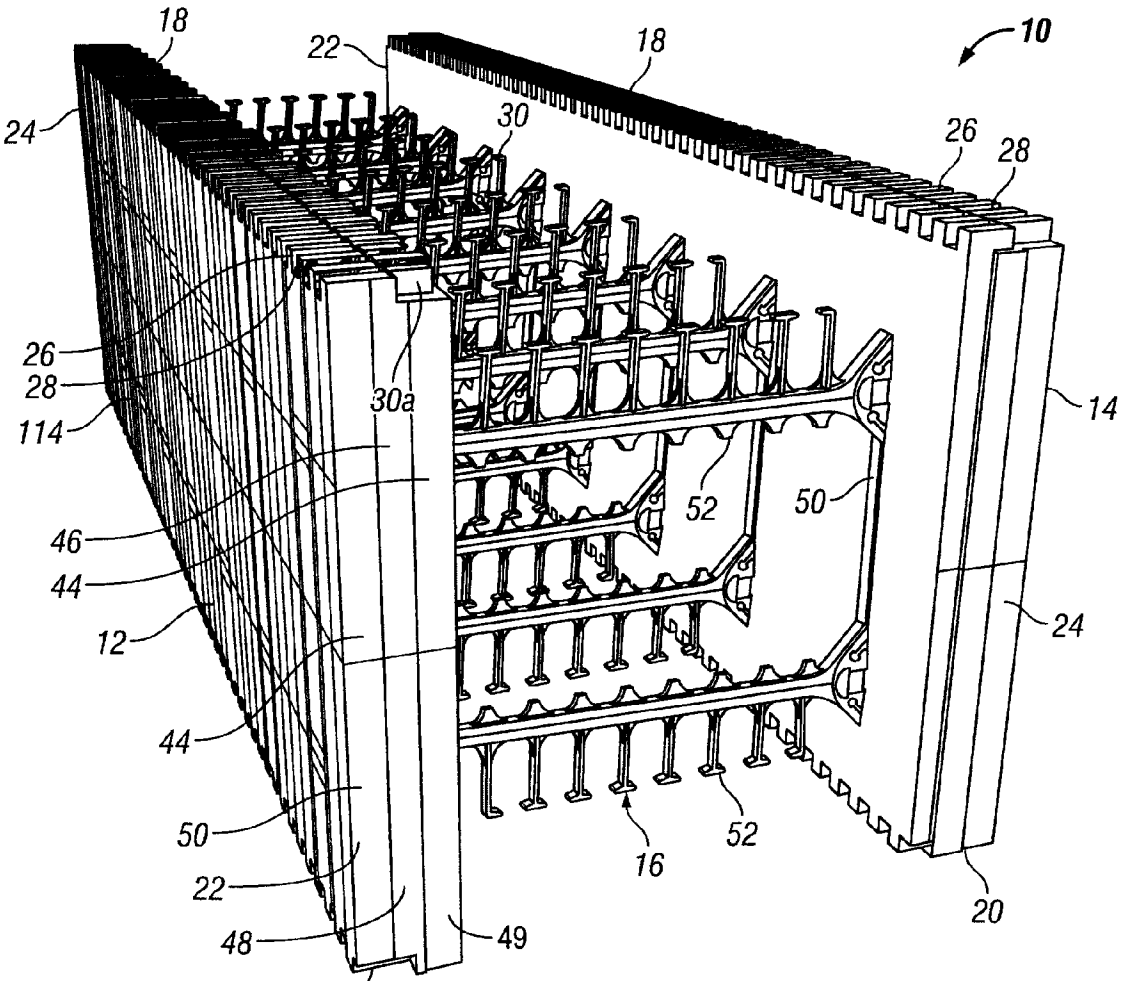
FIG. 1 is a perspective view of an insulating concrete block constructed in accordance with the inventive concepts disclosed herein.

Referring now to the drawings, and more particularly to FIG. 1, a knockdown insulating concrete block 10 (referred to hereinafter as "block 10") is illustrated. The block 10 is adapted to be shipped in a flat, unassembled condition, and then assembled at a job site. Once assembled, the block 10 is adapted to be interlocked with other insulating construction blocks to form an insulating concrete form for casting concrete. The block 10 is formed from two panels 12 and 14 interconnected to one another with a plurality of web structures assemblies 16.

Each of the panels 12 and 14 has a top end 18, a bottom end 20, a first end 22, and a second end 24. The top end 18 and the bottom end 20 of the panel 12 are shown to be provided with an outside row of a plurality of projections 26 which are spaced apart to define a plurality of corresponding recesses 28 and an inside row of projections 30 and 30*a* which are spaced apart to define a plurality of recesses 32. The projections 30 and 30*a* of the inside row are different in size to one another and are alternated relative to one another. Moreover, the projections 30 and 30*a* of the inside row are each different in size to the projections 26 of the outside row. Preferably, the projections and recesses along the bottom end 20 of each panel 12 and 14 are offset relative to the top end 18 wherein a recess on the bottom end 20 opposes a projection on the top end 18 of corresponding size and a projection on the bottom end 20 opposes a recess on the top end 18 of corresponding size with the exception that the recesses of the inner rows are sized to receive either of the projections of the inner row.

It will be appreciated that while the panel 12 has been described to include alternating projections and recesses of varying sizes, numerous systems exist for interlocking insulating concrete forms. By way of example, the panel 14 has been illustrated to have projections of the same size. Other examples of panel structures are described in U.S. Pat. Nos. 6,820,384; 5,896,714; 4,698,947; 6,792,729; 6,401,419; and 5,014,480; each of which is expressly incorporated herein by reference.

The first end 22 and the second end 24 of the panels 12 and 14 may also be provided with a tongue and groove pattern that allows for a mating interconnection with the end of another panel. More specifically, the first end 22 of the panel 12 has an upper pair of projections 44 spaced apart to form a recess 46 and a lower projection 48 defining a pair of recesses 49 on each side thereof. Similarly, the second end 24 of the panel 12 is formed to have projections and recesses. However, the projections and recesses on the second end 24 are offset relative to the first end 22 wherein a recess on the second end 24 opposes a projection on the first end 22 and a projection on the second end 24 opposes a recess on the first end 22. In a preferred version, the projections of the first and second ends 22 and 24 are provided with a shallow profile to permit the first and second ends 22 and 24 of the panel 12 to abut the end of another panel that may not have a corresponding tongue and groove pattern. For example, if a block is vertically cut, it is still desirable that the first and second ends abut a smooth end surface. To this end, a preferred height of the projections is approximately 1 mm.

The panels 12 and 14 can be formed from fire retardant expanded polypropylene, polystyrene, polyethylene or other suitable polymers with expanded polystyrene commonly referred to as "EPS" being preferred. Subject to indentations and protrusions of minor dimensions, which can be any structure used to connect the forms together vertically to form a wall as discussed below, the panels are of generally uniform rectangular cross-section. In a typical case, each panel may be 48 inches long, 16.50 inches high and 2.50 inches thick. However, it will be appreciated that the panels may constructed in a variety of shapes and sizes.

The exterior face 114 of the panels 12 and 14 may be provided with a series of vertical markings and horizontal markings to serve as guidelines for assisting the installer to cut the block 10 to a desired size. The vertical markings are preferably spaced at one inch intervals; however, it will be appreciated that other intervals may be used. In addition, the vertical markings are identified with numerals much like a measuring tape. This allows an installer to cut blocks many times without the need of marking the cut point on the block, or many times eliminating the need to measure the form during the installation or cutting process of installation. This will save time and money during the installation process.

The horizontal markings may include a center line, a pair of upper lines, and a pair of lower lines. These horizontal lines may be spaced every 2 inches from the center line. This allows an installer making horizontal cuts to have a line to follow for cutting straight whether they cut directly on the line or not.

The panels 12 and 14 may further include a series of markings indicating the position of the web structures assemblies 16, and in particular an attachment element to be described below.

The panels 12 and 14 are assembled with the web structure assemblies 16 of desired dimension so that the outside rows are adjacent the outside of the block 10 and the inside rows are adjacent the inside of the block 10. In addition to the projections and recesses of the outside and inside rows alternating in the longitudinal direction, the projections and recesses alternate across the top end and the bottom end going from one panel 12 to the other panel 14. Similarly, the projections and recesses of the first and second ends of the panels 12 and 14 alternate going from the panel 12 to the panel 14. The projections and recesses permit the stacking and interconnection of a plurality of like blocks 10 as would be required in the construction of a wall or similar arrangement. Projections and recesses of the block 10 are substantially symmetrical, thereby permitting the interconnection of like blocks in a bi-directional and/or reversible manner.

Referring now to FIGS. 1-4, each web structure assembly 16 includes a pair of web inserts 50 and a pair of bridges 52. The web inserts 50 are adapted to be molded in the panels 12 and 14 while the bridges 52 are adapted to be connected to the web inserts 50 so as to extend between the panels 12 and 14.

The web insert 50 may be formed from a single integral unit molded of plastic, such as a high-density flame retardant polypropylene, although flame retardant polyethylene, polystyrene and other suitable polymers may be used. The web insert 50 includes an elongated end plate 54, a strip member 56, a pair of attachment elements 58, and a pair of central male connector members 60 with each central male connector member 60 being accompanied by a pair of lateral male connector members 62. The attachment elements 58 and the connector members 60 and 62 are generally symmetrically disposed above and below a central horizontal axis of the web insert 16.

The end plate 54 is recessed into the panel 12 or 14 such that its outer surface is set back a distance from the exterior surface of panel 12 or 14. However, the end plate 54 may be positioned such that the end plate 54 is substantially flush with the exterior surface of the panel 12 or 14. End plate 54 is oriented in the top-to-bottom or vertical direction relative to the panel 12 or 14 as they would be positioned in use in a vertical wall.

The strip member 56 is oriented in the top-to-bottom direction of the panels 12 and 14 and lies in a plane that is generally parallel to the end plate 54. The strip member 56 has opposite ends that curve outwardly toward end plate 54. The function of the strip member 56 is to assist in positioning the web insert 50 in a mold before the foam material is injected into the molds to form foam panels 12 and 14, and also to seal against the flow of foam beyond the desired inner surfaces of panels 12 and 14, respectively.

Figure 10:
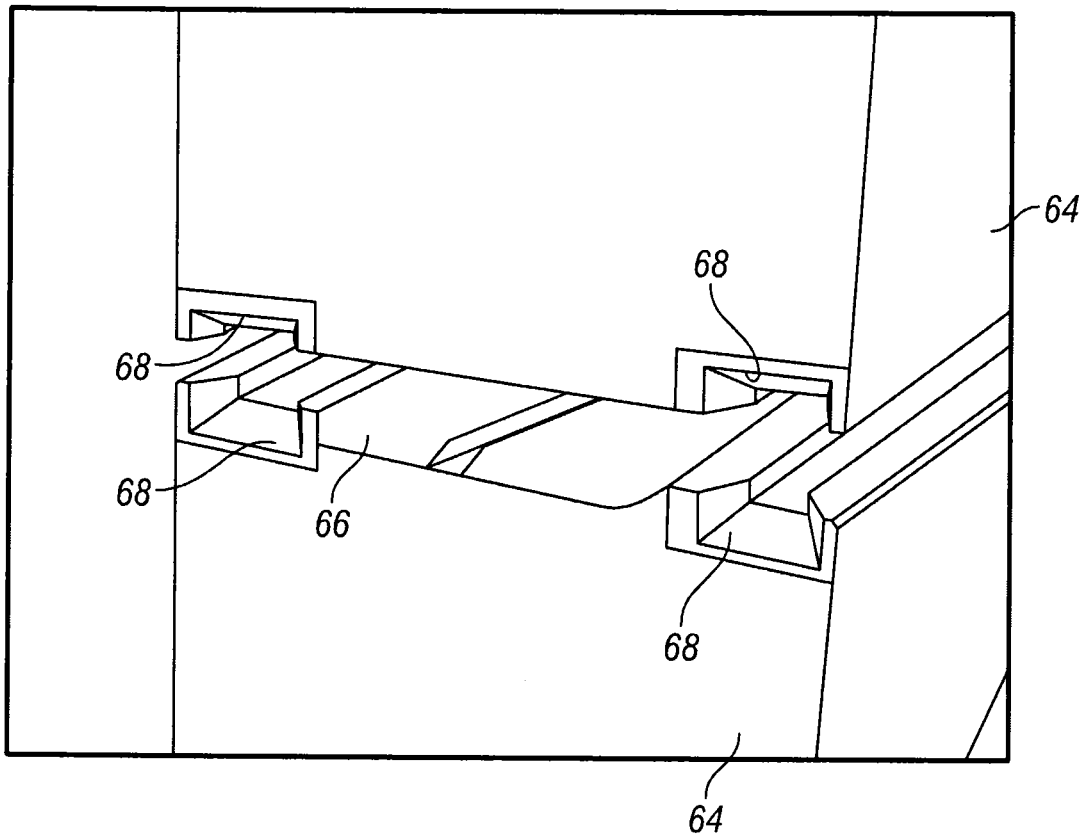
FIG. 10 is a perspective view of a mold insert for forming the insulating concrete block of FIG. 1

FIG. 10 illustrates a pair of corresponding mold inserts 64 which make up a portion of the mold for forming the panels 12 and 14. The mold inserts 64 include a slot 66 for receiving an integral web structure as disclosed in U.S. Ser. No. 11/296,627, or alternatively a pair of web inserts, such as web inserts 50 described herein. The mold inserts 64 include a pair of opposing grooves 68 adapted to receive the male connector members 60 of the web inserts 50. This provides the advantage of not requiring the mold insert to be changed when changing production from an insulating concrete form having an integral web structure to a knockdown insulating concrete form.

With respect to the web inserts 50, the web inserts 50 are molded into the panels 12 and 14 in the course of producing the panels 12 and 14 such that the end plate 54 is encased within the foam making up the panels 12 and 14. In the block 10, strip member 56 is flush with the inner surface of the panel 12. End plate 54 may be of substantially equal height as the panel 12 and may be substantially flush with the top and bottom ends of the panels, which does require them to extend completely to the ends. In fact, in one embodiment it is preferred for the end plate 54 to stop a short distance from the top and bottom ends of the panels 12 and 14 to facilitate connection and stacking of the blocks 10 to build a wall to facilitate the installation of wiring and plumbing after concrete is poured into the blocks 10.

The blocks 10 are stacked when building a wall so that the end plates 84 are vertically aligned to form continuous furring strips for attaching finishing materials to the completed wall. To this end, the end plate 84 is provided with attachment elements 58 which are formed by providing thickened areas on the end plate 54. More specifically, the attachment elements 58 are in the form of boss like blocks extending inwardly a distance from the end plate 54 and extending the width of the end plate 54. The attachment elements 58 may be formed of any desired thickness so long as the attachment elements 58 are sufficiently thick to hold a selected fastener. To facilitate the manufacture of the web insert 50, the attachment elements 58 are provided with voids 100*a* and 100*b* separated by a brace 102.

The attachment elements 58 are spaced on eight inch intervals vertically, thereby allowing one to fasten screws or gun nails to it with superior holding power over the balance of the web face. The positioned of the web insert 50 in the panels 12 and 14 further causes the attachment elements 58 to be spaced vertically on eight inch intervals with the attachment elements 58 of adjacently stacked panels. As described above, the locations of the attachment elements 58 are marked on the exterior face of the panels 12 and 14. This facilitates the attachment of bracing during the installation process, hanging of cabinets, precious pictures or other items that need a more secure holding area with far superior strength than otherwise possible with other webs. Of course, one of ordinary skill in the art will recognize that alternative embodiments of the invention include the end plates being completely buried within the foam panels 12 and 14, or being partially buried, in which case, portions of the end plates would be exposed, such as by the formation of openings through the foam panels, as is known in the art. The end plate 54 could also extend above and/or below the top and bottom of the panels.

The end plate 54 is supported relative to the strip member 56 by a plurality of support members or trusses. More specifically, one half of the web insert 50 is provided with three diverging support members 88*a*, 88*b*, and 88*c* extending between the strip member 56 and the end plate 54. Diverging support member 88*a* merges with the end plate 54 near the upper end of the end plate 54. Diverging support member 88*b* merges with the attachment element 58 to support the attachment element 58. Diverging support member 88*c* merges with end plate 54 at its distal end near the center of the end plate 54.

Figure 2A:
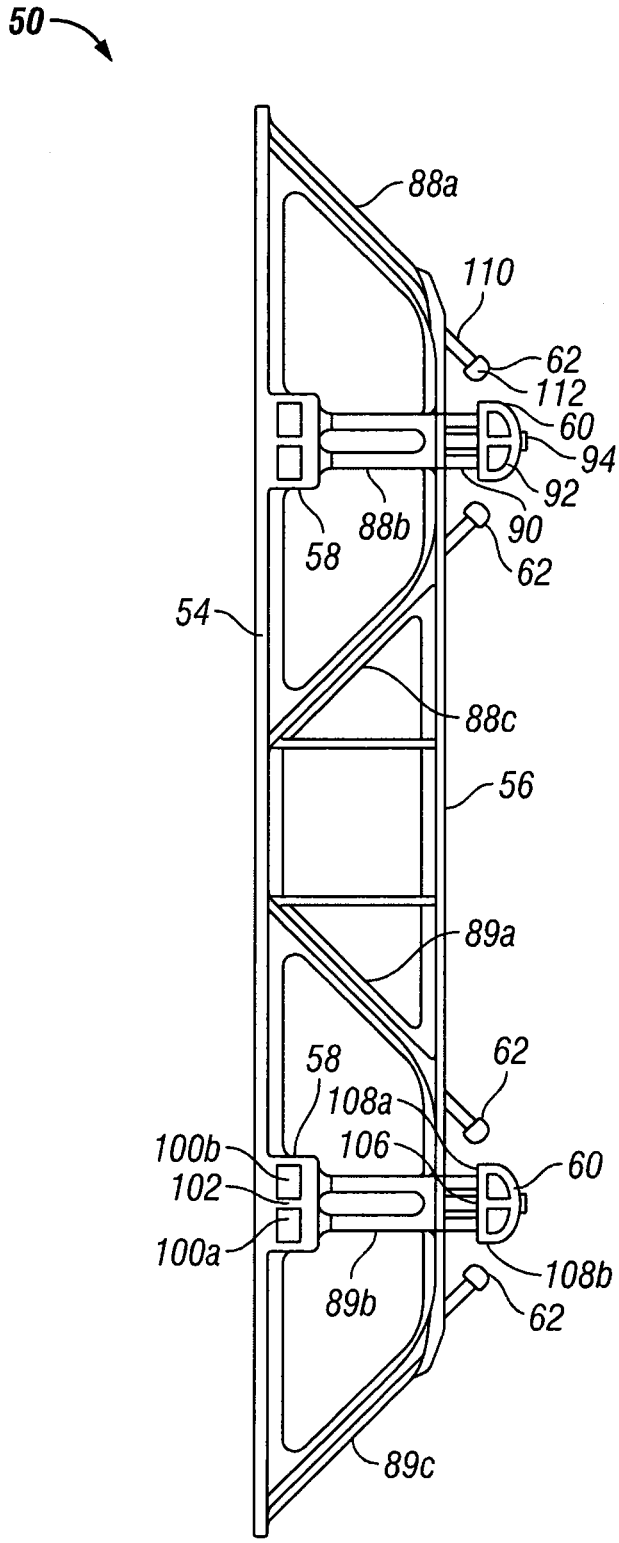
FIG. 2A is a side elevational view of a web insert.
Figure 2B:
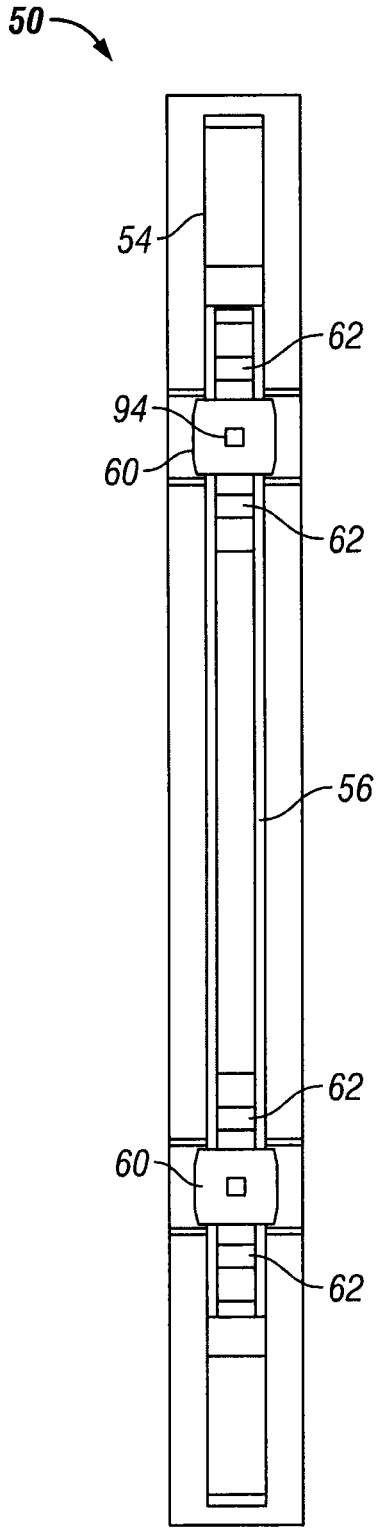
FIG. 2B is a front elevational view of the web insert of FIG. 2A.

The central connector member 60 extends from the strip member 56 in alignment with the support member 88*b* and the attachment element 58 corresponding thereto. The central connector member 60 has a shaft 90 and a head 92. The shaft 90 is aligned with the support member 88*b* and functions to space the head 92 from the strip member 56. The head 92 is shown in FIG. 2B to have a width greater than the width of the strip member 56 so that when the head 92 is received in the grooves 68 of the mold insert 64, the head functions to secure the web insert in the mold insert. The head 92 is provided with a boss or protrusion 94 adapted to interlock with the bridge 52 in a manner to be described below. As best shown in FIG. 2A, the head 92 has a proximal side 106 that is shaped to have a slightly curved profile so that the opposing ends 108*a* and 108*b* of the head 92 define acute angles. Web insert 16 is substantially symmetrical about horizontal axis such that the other half of the web insert similarly includes diverging support members 89*a*, 89*b*, and 89*c* merging with end plate 54.

The lateral male connector members 62 each extend from the strip member 56 in alignment with the support members 88*a* and 88*c*, respectively, and each include a shaft 110 and a head 112.

Like the attachment elements 58, the central male connecting members 60 are spaced approximately every eight inches, by way of example, when stacked vertically. This allows the blocks or forms when cut in half horizontally to be identical as well as having the cross member extend through the middle with equal distance from top or bottom once stacked with other blocks or forms. This gives equal strength to the bottom and top of the ½ size cut block or form.

Figure 3A:
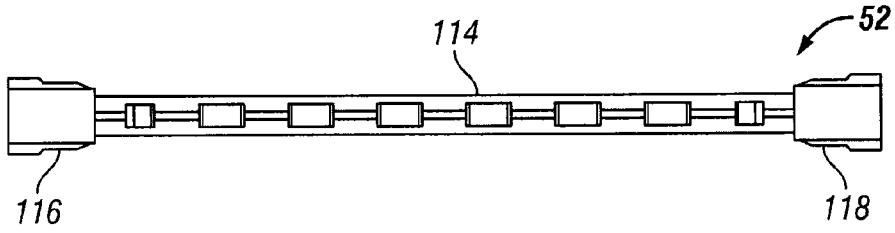
FIG. 3A is a top plan view of a web bridge.
Figure 3B:
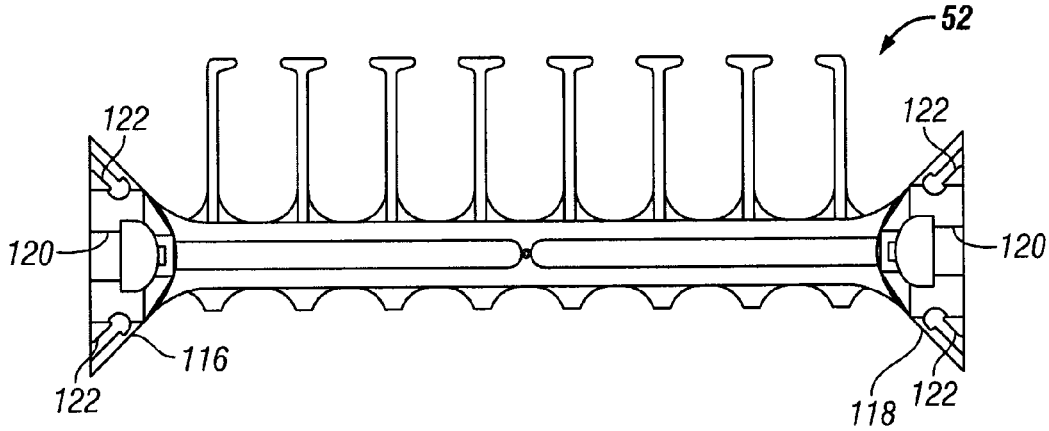
FIG. 3B is a front elevational view of the web bridge of FIG. 3A.
Figure 3C:
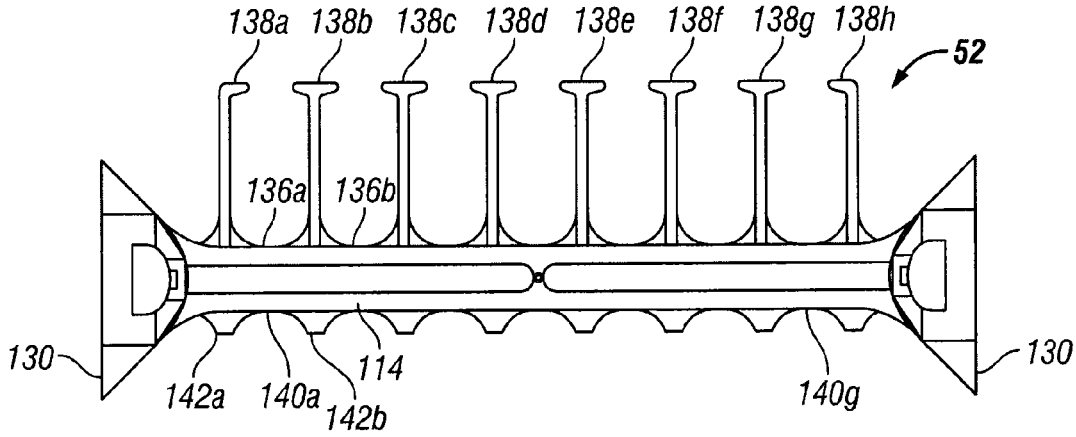
FIG. 3C is a back elevational view of the web bridge.
Figure 4:
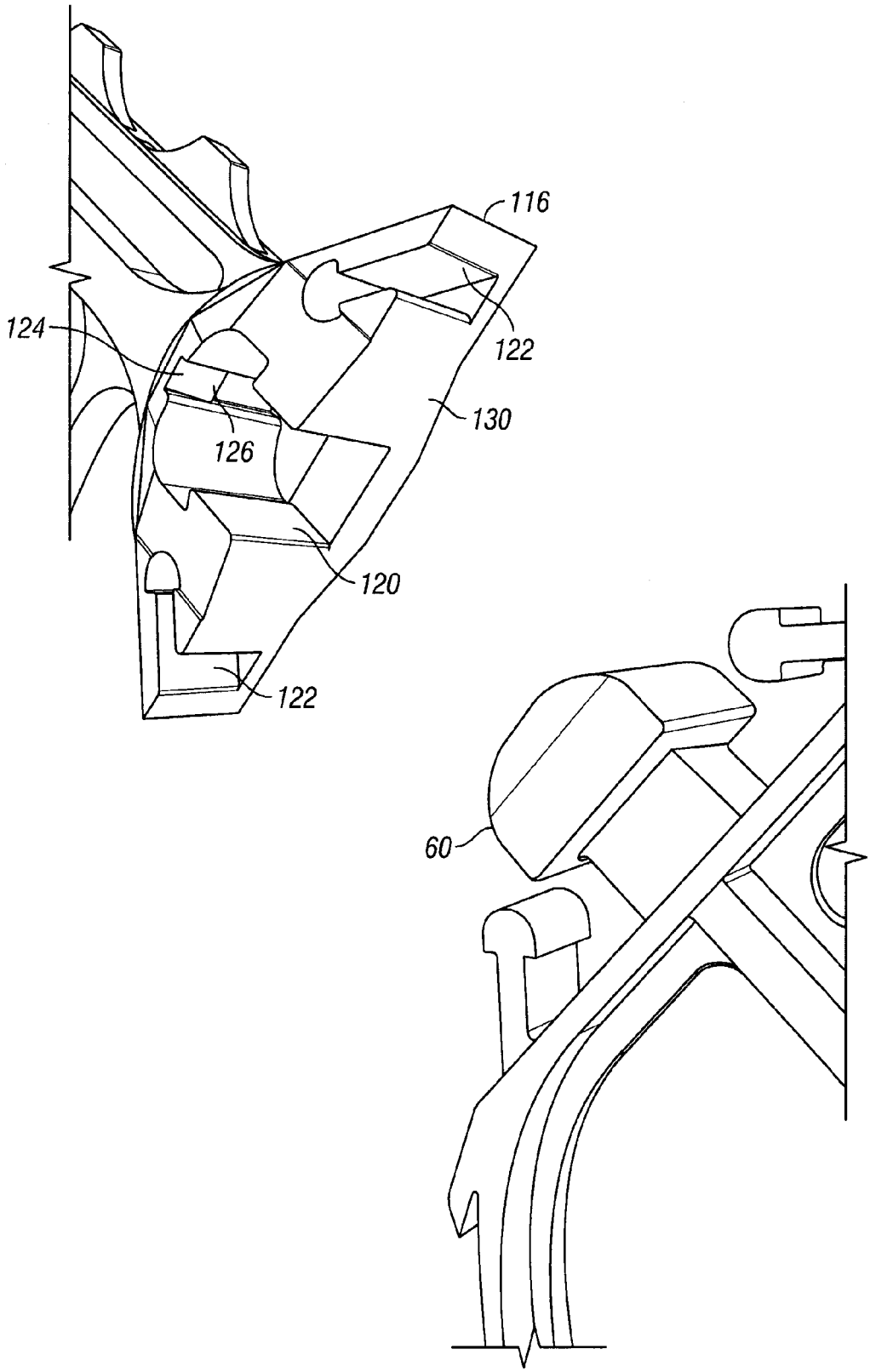
FIG. 4 is a perspective view of one end of the web insert and one end of the web bridge shown in an unconnected condition.

Referring now to FIGS. 3A-3C, the bridge 52 has a cross member 114, a first female connector member 116 formed on one end of the cross member 114, and a second female connector member 118 formed on the other end of the cross member 114. Each of the female connector members 116 and 118 is adapted to receive the central male connector member 60 and the lateral male connector members 62 of the web insert 50. To this end, each of the female connector members 116 and 118 has a central cavity 120 and a pair of lateral cavities 122. Each of the cavities 120 and 122 are shaped to matingly receive the central male connector member 60 and the lateral male connector members 62, respectively, and the female connector members 116 and 118 are configured to receive the male connector members 60 and 62 from a lateral side of the female connector members 116 and 118. More specifically, the cavities 120 and 122 are defined in part by open lateral sides, as shown in FIG. 3B. FIG. 4 shows one of the central male connector members 60 and corresponding lateral male connector members 62 in an exploded view relative to one of the female connector members 116.

The central cavity 120 is provided with a groove 124 for receiving the protrusion 94 of the head 92 of the central male connector member 60. The groove 124 is partially defined by a ramp 126 (FIG. 4) configured to slidingly receive the protrusion 94 and thereafter to capture the protrusion 94 to lock the head 92 in the central cavity and thereby secure the bridge 52 to the web insert 50.

One side of the cross member 114 is formed to have a series of seats for rebar positioning. More particularly, seats 136*a*, 136*b*, 136*c*, 136*d*, 136*e*, 136*f*, and 136*g* are defined by restraining fingers 138*a*, 138*b*, 138*c*, 138*d*, 138*e*, 138*f*, 138*g*, and 138*h* respectively. The distal end of each of the restraining fingers is provided with a flange and the restraining fingers are laterally flexible to permit insertion of the rebar in the seats. As shown, the seats are dimensioned to receive at least two pieces of rebar in a vertical orientation as illustrated in FIG. 3B, thereby eliminating the need to tie overlapping sections of rebar together.

The opposing side of the cross member 114 is formed to have seats in the form of saddles 140*a*, 140*b*, 140*c*, 140*d*, 140*e*, 140*f*, and 140*g*. By omitting the restraining fingers, the saddles on the inner side of the cross member permit better flow of the concrete through the block 10 during the concrete pouring process. The saddles 142*a*-142*h* are used to hold rebar in place if the block 10 is cut in half horizontally to make half height blocks. However, if it is desirable to hold two pieces of rebar in both the upper bridge and the lower bridge, the configuration of the bridge 52 and web insert 50 is such that the bridge 52 is reversible. That is, the bridge 52 may be connected to the web inserts 50 with the restraining fingers in an upwardly extending position or in a downwardly extending position. The female connector members 116 and 118 have a generally flared configuration such that a distal end 130 is in contact with the strip member 56 of the web insert 50 when the bridge 52 is connected to the web insert 50. This, together with the central connection and the lateral connections, enhances the rigidity of the connection between the web insert 50 and the bridge 52.

Figure 5A:
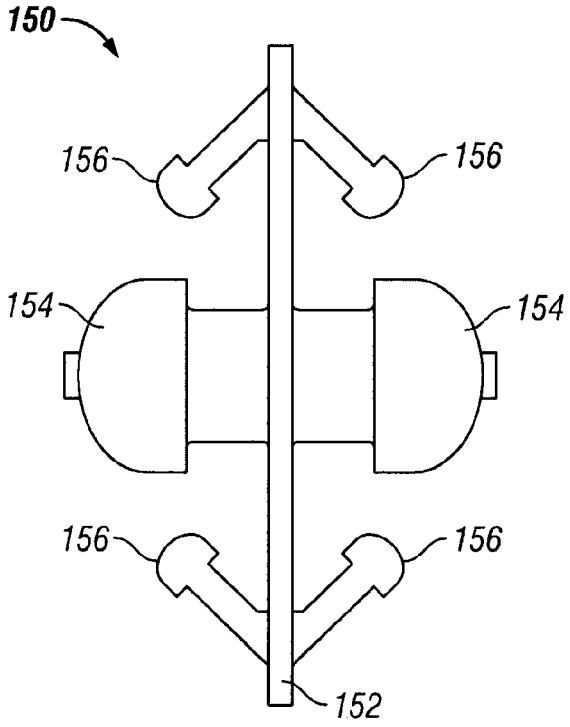
FIG. 5A is a side elevational view of a web splice.
Figure 5B:
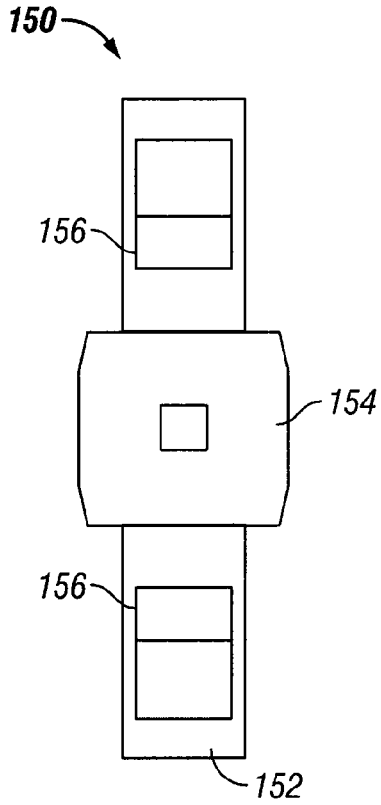
FIG. 5B is an end view of the web splice.
Figure 5C:
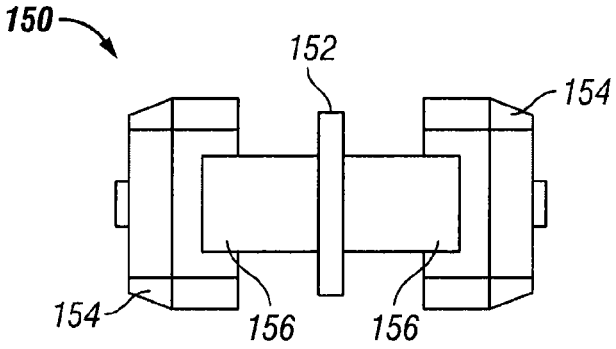
FIG. 5C is a top plan view of the web splice.

FIGS. 5A-5C show various views of a web splice 150. The web splice is utilized to connect multiple bridges 52 together in an end to end relationship. The web splice 150 includes a base plate 152 with a central male connector 154 extending from each side of the base plate 152 and a pair of lateral male connectors 156 extending from the base plate 152.

Figure 6A:
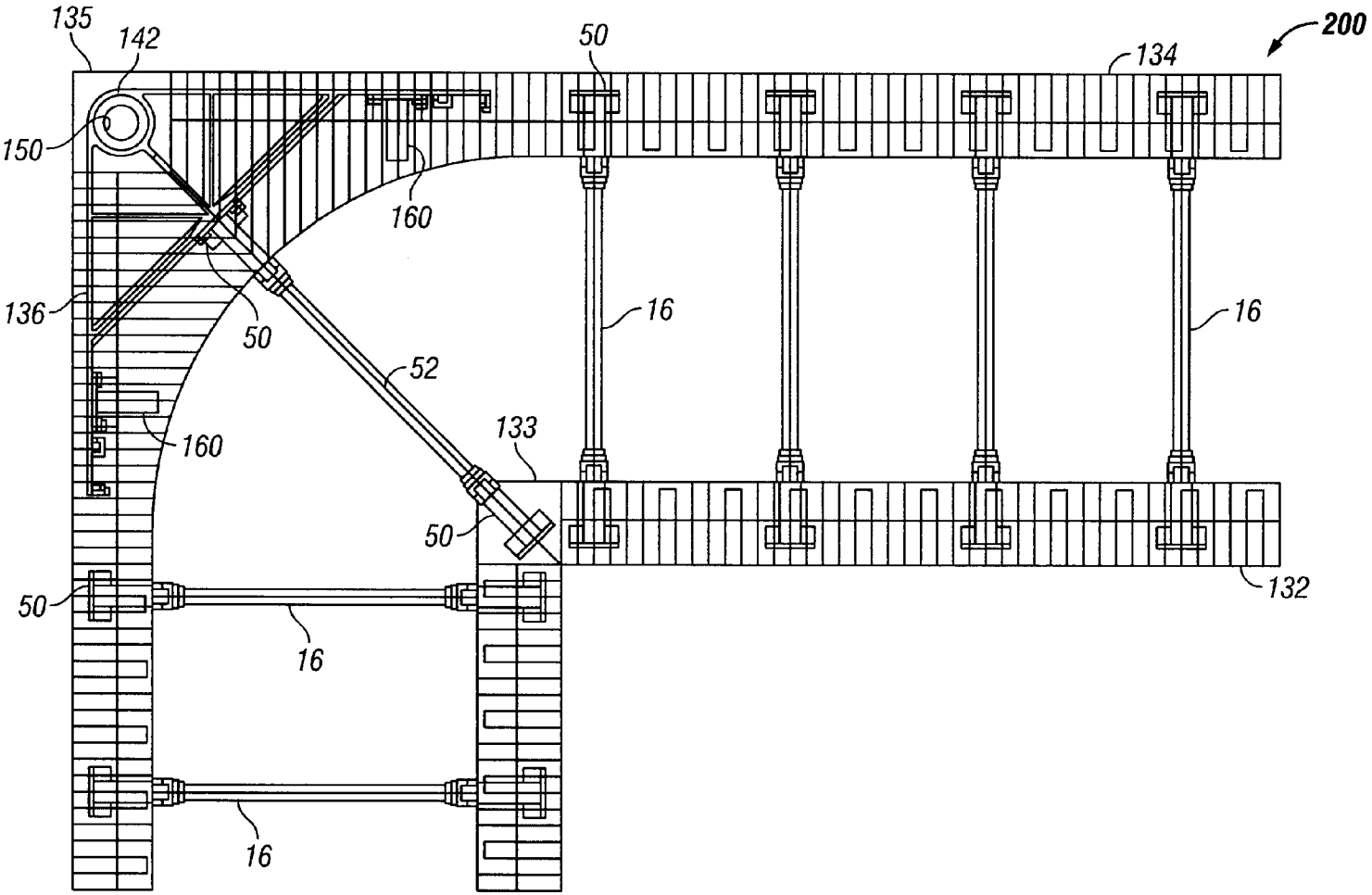
FIG. 6A is a top plan view of a corner insulating concrete block constructed in accordance with the inventive concepts disclosed herein.
Figure 6B:
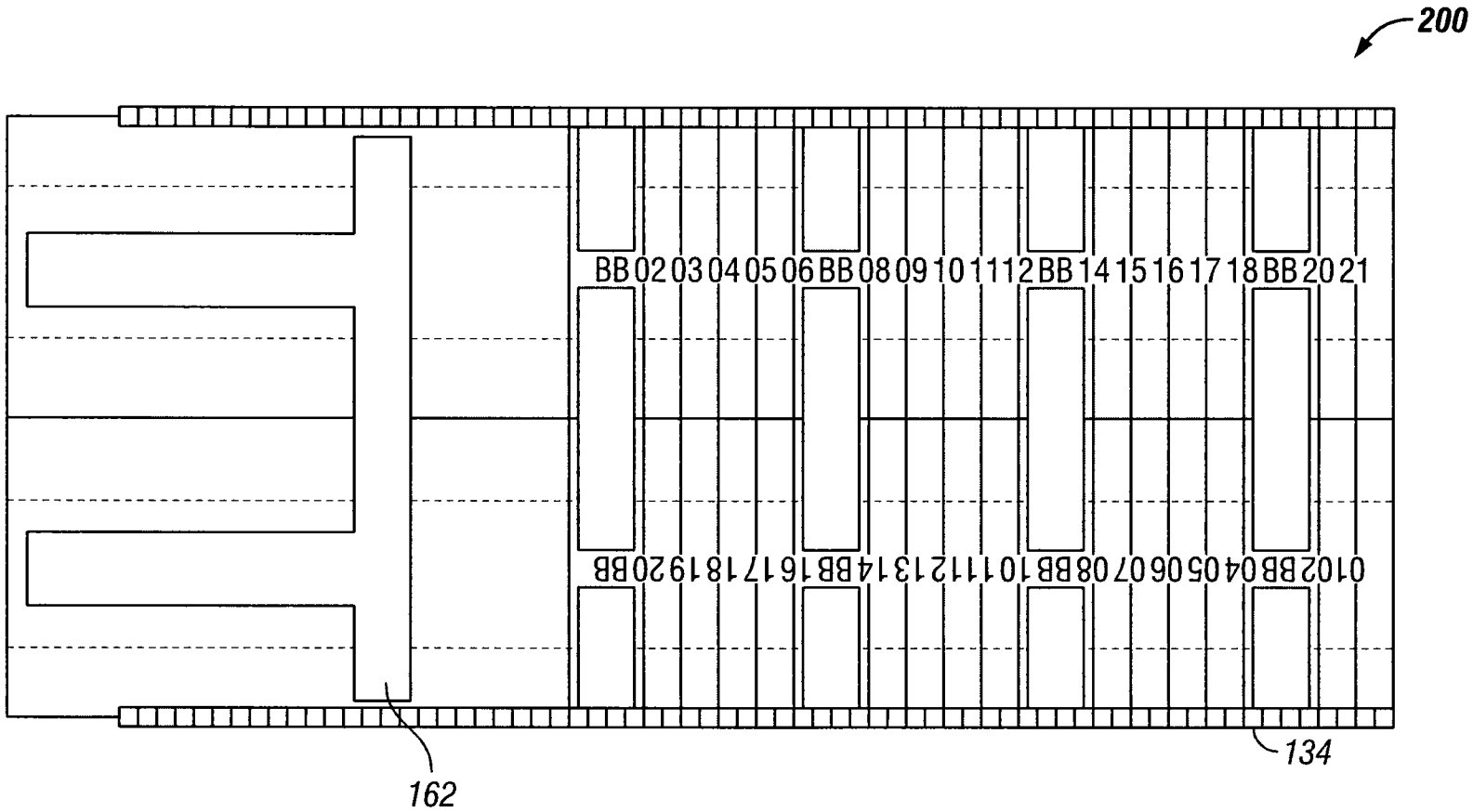
FIG. 6B is a side elevational view of the corner insulating block of FIG. 6A.

FIGS. 6A and 6B illustrate a 90 degree corner block 200 constructed in accordance with the presently disclosed inventive concepts. The corner block 130 includes an inner panel 132 defining a corner 133 and an outer panel 134 defining a corner 135 interconnected to one another with a plurality of web structure assemblies 16. A corner web assembly 136 is positioned in the corner 135 of the outer panel 134 so that upon cutting the corner block 200 in half horizontally, the corner web 136 is cut in half allowing one half of the web to remain in each half of the block for attaching items to it.

Figure 7:
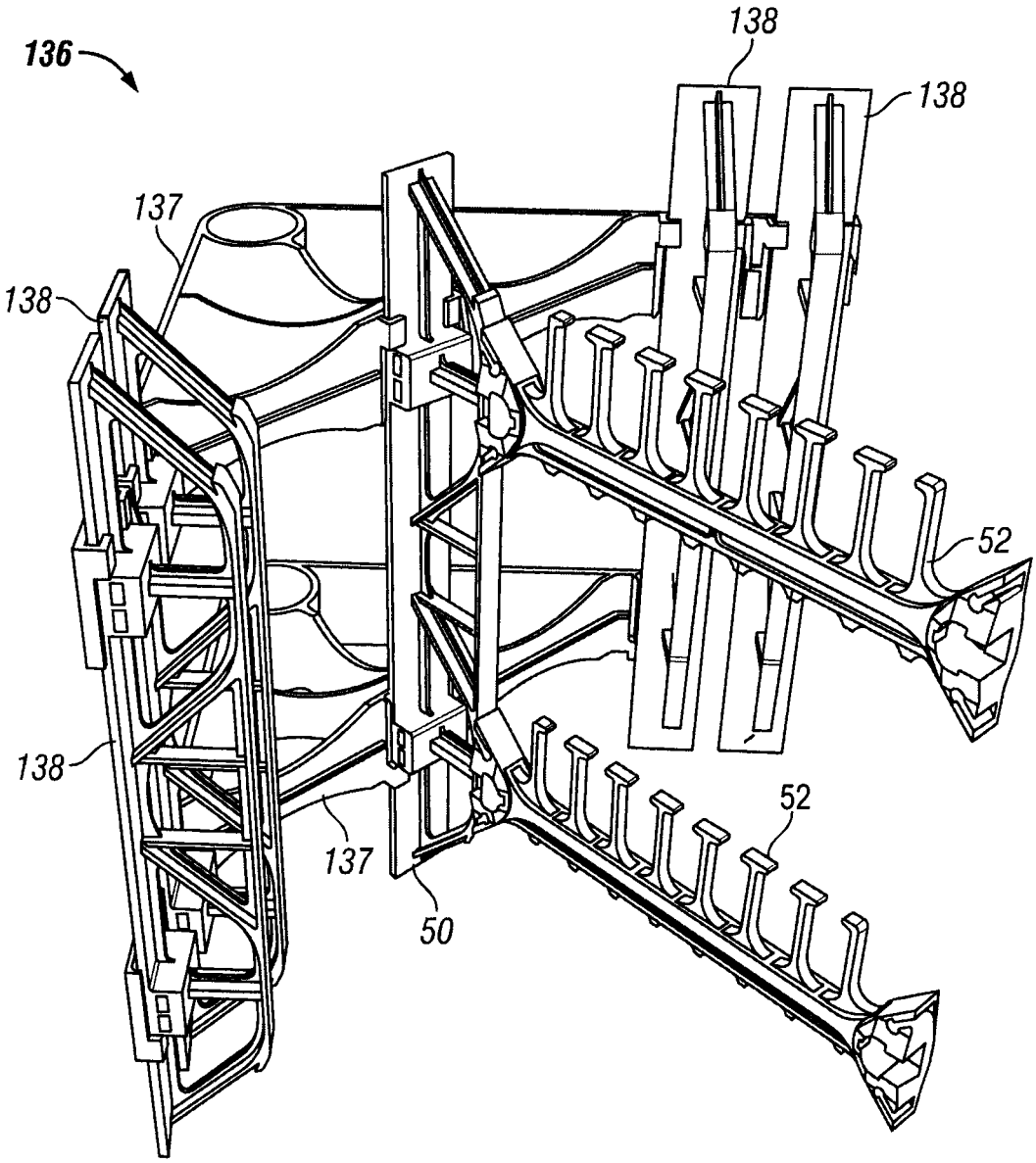
FIG. 7 is a perspective view of a corner web assembly.
Figure 8:
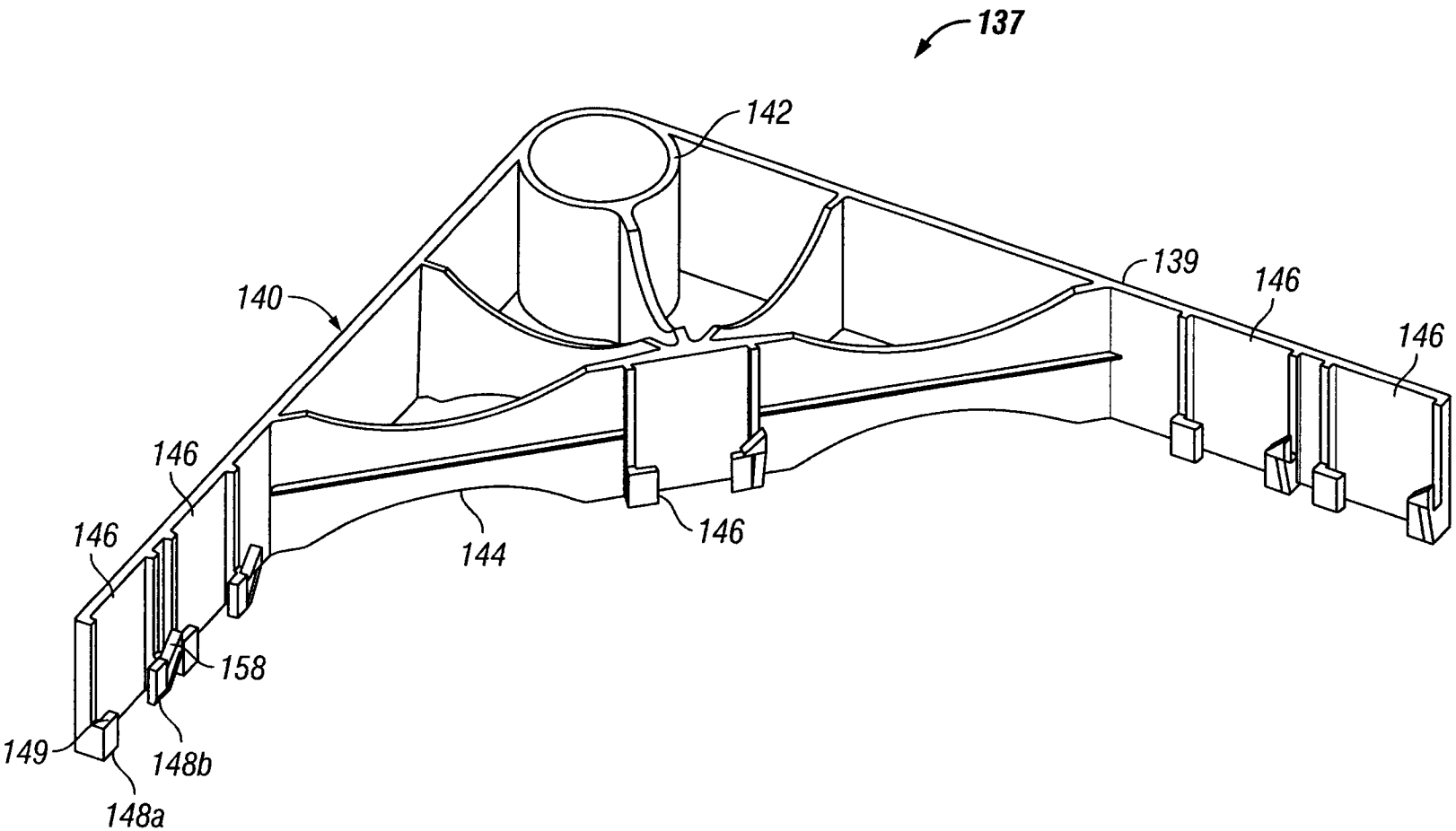
FIG. 8 is a perspective view of a corner web insert.
Figure 9:
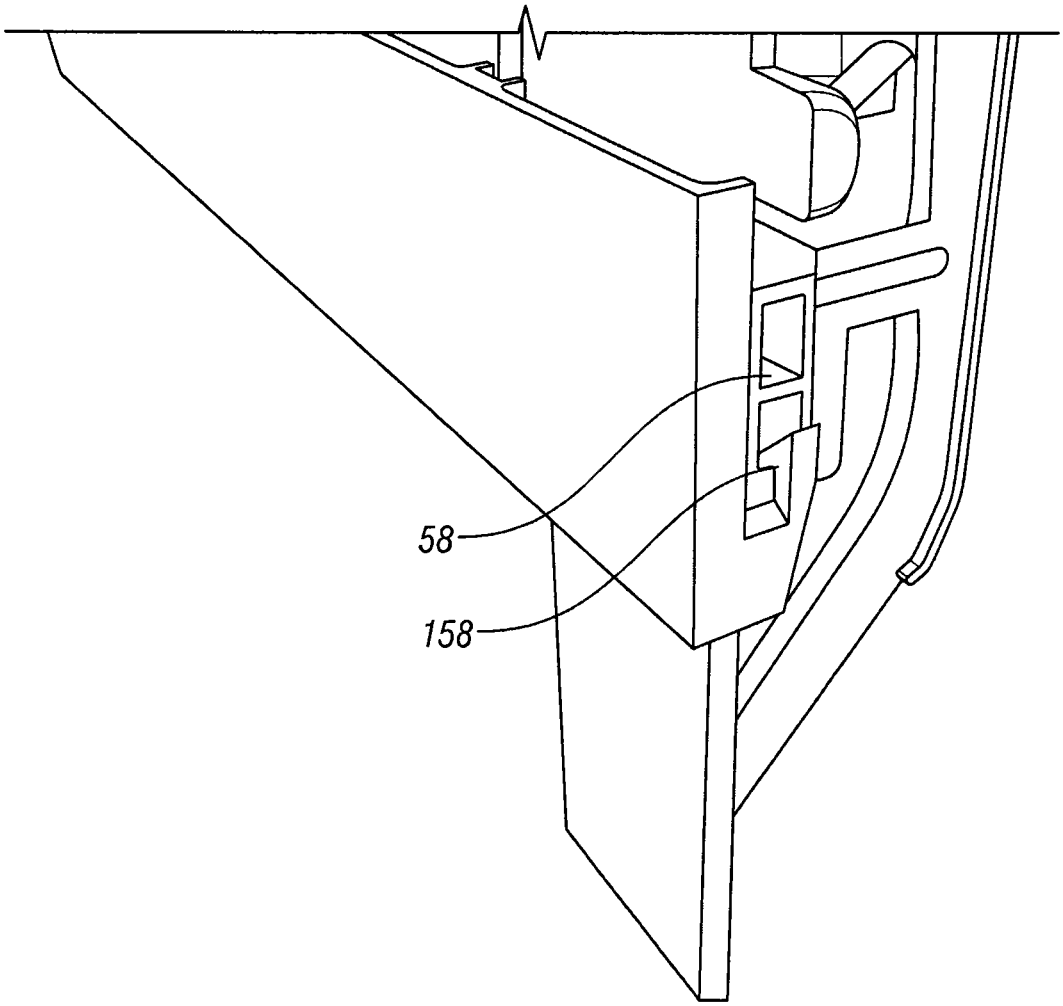
FIG. 9 is a fragmented perspective view of a portion of the corner web insert shown connected to a web insert

Referring to FIGS. 7-9, the corner web assembly 136 includes a pair of corner webs 137, and a plurality of web inserts 138 connected to the corner webs 137 so as to tie the corner webs 137 together. Each of the corner webs 137 (FIG.

8) is a substantially L-shaped member with a first leg 139 and a second leg 140. A tube 142 is formed on the inner side of the intersection of the first leg 139 and the second leg 140. The first leg 139 is additionally connected to the second leg 140 with a brace 144.

In forming the outer panel 134, a hole 150 is formed which is aligned with the tube 142. The hole 150 and the tube 142 are sized to allow a piece of pipe, such as a standard ¾ inch schedule 40 PVC pipe, to be placed vertically through the hole 150 and the tube 142 when the corner blocks 200 are stacked. This allows a vertical attachment point for fastening items to the pipe the entire length of the stacked corner of the corner blocks 200. This also prevents the stacked corner blocks 200 from pulling away from the other corner blocks or the blocks 10.

The first and second legs 139 and 140 of the corner webs 137 are each shown to be provided with a pair web insert receiving elements 146 positional distally relative to the brace 144. The web insert receiving elements 146 include a pair of opposing arms 148*a* and 148*b* cooperating to define a slot 149. One of the arms 148*b* is provided with a flexible tab 158 for locking a web insert 160 (FIGS. 6A and 9) in the slot 149. As shown in FIG. 9, the flexible tab 158 is positioned to be inserted into one of the voids 100*a* or 100*b* of the attachment element 58 to secure the web insert 160 to the corner web 137. The web insert 160 is similar to the web insert 50 described above, but has had the male connectors removed or omitted. The web inserts 160 are provided on the corner web 137 to provide a point of attachment on six inch spacing with the adjacent web inserts 50. To this end, a web insert 160 is positioned in the appropriate slot 146 to achieve the desired spacing depending on the size of the corner block.

Like the panels 12 and 14, the panels 133 and 134, the exterior face of the panels 133 and 134 (panel 134 shown in FIG. 6B) may be provided with a series of vertical markings and horizontal markings o serve as guidelines for assisting the installer to cut the block 200 to a desired size. The vertical markings are spaced at one inch intervals; however, it will be appreciated that other intervals may be used. In addition, the vertical markings are identified with numerals much like a measuring tape. This allows an installer to cut blocks many times without the need of marking the cut point on the block, or many times eliminating the need to measure the form during the installation or cutting process of installation. This will save time and money during the installation process. The horizontal markings may include a center line, a pair of upper lines, and a pair of lower lines. These horizontal lines may be spaced every 2 inches from the center line. This allows an installer making horizontal cuts to have a line to follow for cutting straight whether they cut directly on the line or not. The panels 133 and 134 may further include a series of markings 162 indicating the position of the web structures assemblies 137.

As shown in FIG. 8, the brace 144 is also provided with web insert receiving element 146 for receiving a web insert 50 has described above. The web insert 50 cooperates with a web insert 50 embedded in the corner of the inside panel 132 to receive and support a bridge 52, as best shown in FIG. 6A.

From the above description, it is clear that the present invention is well adapted to carry out the objects and to attain the advantages mentioned herein as well as those inherent in the invention. While exemplary embodiments of the invention have been described for purposes of this disclosure, it will be understood that numerous changes may be made which will readily suggest themselves to those skilled in the art and which are accomplished within the spirit of the invention disclosed herein.

What is claimed is:

1. A web structure for connecting two foam panels, comprising:

a pair of web inserts adapted to be molded in the foam panels, each of the web inserts having an elongated end plate and a pair of central male connector members supported by the elongated end plate; and a pair of bridges connected to the web inserts so as to extend between the foam panels, each of the bridges having a cross member, a first female connector member formed on one end of the cross member and a second female connector member formed on an opposing end of the cross member, the first and second female connector members each having a cavity shaped to matingly receive one of the central male connector members of the web inserts from a lateral side of the first and second female connector members, wherein each of the web inserts further comprises a pair of lateral male members supported symmetrically above and below the central male connector member and wherein each of the first and second female connectors of the bridge has a pair of lateral cavities shaped to matingly receive one of the lateral male connector members from a lateral side of the first and second female connector members whereby the bridge is connectable to the web inserts in a reversible manner.

2. The web structure of claim 1 wherein each of the web inserts further comprises:

a strip member; and a plurality of support members supporting the strip member in a parallel, spaced apart relationship to the end plate, wherein the central male connector members and the lateral male members extend from the strip member in alignment with one of the support members.

3. The web structure of claim 2 wherein the central male connector members and the lateral mate connector members each have a shaft extending from the strip member and a head extending from the shaft so as to be spaced from the strip member.

4. The web structure of claim 3 wherein the central male connector members and the strip members each have a width and wherein the width of the central male connector members is greater than the width of the strip members.

5. The web structure of claim 1 wherein the first and second female connectors have a flared distal end in contact with the strip member when the bridge is connected to the web insert.

6. An insulating concrete block, comprising:

a first foam panel and a second foam panel arranged in a spaced apart, parallel relationship to form a concrete receiving cavity, each of the first panel and the second panel having a top end, a bottom end, a first end, and a second end; and at least one web structure extending between the first foam panel and the second foam panel, the web structure comprising:

a pair of web inserts molded in the foam panels, each of the web inserts having an elongated end plate and a pair of central male connector members extending from the foam panels and supported by the elongated end plate; and a pair of bridges connected to the web inserts so as to extend between the foam panels, each of the bridges having a cross member, a first female connector member formed on one end of the cross member and a second female connector member formed on an opposing end of the cross member, the first and second female connector members each having a cavity shaped to matingly receive one of the central male connector members of the web inserts from lateral side of the first and second female connector members, wherein each of the web inserts further comprises a pair of lateral male members supported symmetrically above and below the central male connector member and wherein each of the first and second female connectors of the bridge has a pair of lateral cavities shaped to matingly receive one of the lateral male connector from a lateral side of the first and second female connector members whereby the bridge is connectable to the web inserts in a reversible manner.

7. The insulating concrete block of claim 6 wherein each of the web inserts further comprises:

a strip member;

a plurality of support members supporting the strip member in a parallel, spaced apart relationship to the end plate, wherein the central male connector members and the lateral male members extend from the strip member in alignment with one of the support members.

8. The insulating concrete block of claim 7 wherein the central male connector members and the lateral mate connector members each have a shaft extending from the strip member and a head extending from the shaft so as to be spaced from the strip member.

9. The insulating concrete block of claim 8 wherein the central male connector members and the strip members each has a width and wherein the width of the central male connector members is greater than the width of the strip members.

10. The insulating concrete block of claim 6 wherein the first and second female connectors have a flared distal end in contact with the strip member when the bridge is connected to the web insert.

* * * * *